US006474802B1

(12) United States Patent
Lui

(10) Patent No.: US 6,474,802 B1
(45) Date of Patent: Nov. 5, 2002

(54) INK CARTRIDGE

(75) Inventor: Pui Kuong Lui, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 0 days.

(21) Appl. No.: 10/014,552

(22) Filed: Dec. 14, 2001

(51) Int. Cl.[7] ..... B41J 2/175
(52) U.S. Cl. ..... 347/86
(58) Field of Search ..... 347/85, 86, 87, 347/49

(56) References Cited

U.S. PATENT DOCUMENTS 6,007,192 A * 12/1999 Ahn ..... 347/87
6,019,465 A * 2/2000 Shinada et al. ..... 347/93
6,264,316 B1 * 7/2001 Chino ..... 347/86
6,273,562 B1 * 8/2001 Deshmukh ..... 347/86

FOREIGN PATENT DOCUMENTS

JP 11-129492 * 5/1999

* cited by examiner

*Primary Examiner*—Michael Nghiem
(74) *Attorney, Agent, or Firm*—Rosenberg, Klein & Lee

(57) ABSTRACT

An ink cartridge includes an ink tank body having a plurality of surfaces defining an accommodating chamber therein and an ink outlet part disposed on one of the surfaces thereof. An ink porous member is positioned in the accommodating space of the tank body. A cover body has an ink charging inlet and an air inlet part communicated with the accommodating space of the tank body, respectively. A ventilated screw with a hollow ring is arranged on the air inlet part of the cover body and defining a ventilated channel therein. A tab mechanism is installed to a position on one side of the cover body. Whereby can efficiently supply ink to an ink delivery needle and avoid leaking during transportation, storage, or operation, and have a wrong prevention function.

4 Claims, 8 Drawing Sheets

INK CARTRIDGE

BACKGROUND OF THE INVENTION

1. Field of The Invention

The present invention relates to an ink cartridge suitable for an ink jet printer, and particularly to an ink cartridge having an air inlet part with a ventilate screw on a cover body thereof, thereby can efficiently supply ink to an ink delivery needle and avoid leaking during transportation, storage, or operation.

2. The Prior Art

In the conventional ink jet printer, the ink is loaded in an ink cartridge for supplying the ink to an ink delivery needle of the ink jet printer due to print paper. Referring to FIG. 1, the ink cartridge generally comprises an ink tank having an ink tank body 1*a* or a plurality of ink tank bodies for loading different color ink, wherein the ink tank body 1*a* is sealed with a cover body 2*a* thereon. The cover body 2*a* has an ink charging inlet 20*a* and an ambient air vent 21*a* and a sealing film 22*a* is attached on a top surface of the cover body 2*a* so as to seal the ambient air vent 21*a*. The tank body 1*a* has a bottom surface disposed with an ink outlet part 10*a*, and an accommodated chamber thereof positioned with an ink porous member 3*a* therein. Furthermore, firstly to remove the sealing film 22*a*, then to mount the ink cartridge into the ink jet printer, and the ink in fluid communication through the ink outlet part 10*a* of the ink tank body 1*a* to the ink delivery needle of the ink jet printer.

In the conventional ink cartridge, the top surface of the cover body 2*a* is formed with a circuitous channel 23*a* (shown in FIG. 2) that is extended with a long distance channel due to the ambient air vent 21*a* for ventilation. Additionally, the ink tank must be ventilated in order to equalize pressure differences for the printer to work properly, however, the ventilation of the ink cartridge often results in some of the ink evaporating during use, especially if the ink cartridge is used infrequently. Furthermore, some cases of the user from carelessly failing to remove the sealing film 22*a* from the cover body 2*a* before it is mounted on the ink delivery needle are mostly occurred.

Therefore, the conventional ink cartridge has some disadvantages what follows:

1. The cover body 2*a* has a complex top surface due to the circuitous channel 23*a*.
2. The ink in the ink cartridge is evaporated easily due to the ambient air vent 21*a*.
3. The users often failed to remove the sealing film 22*a* from the cover body 2*a* before it is mounted on the ink delivery needle due to no wrong prevention mechanism.

SUMMARY OF THE INVENTION

The primary purpose of the present invention is to provide an ink cartridge which can provide an air inlet part with a ventilate screw on a cover body thereof for ventilation, whereby the ink in an ink tank can be efficiently flowed out through an ink outlet part to an ink delivery needle of the ink jet printer.

Another purpose of the present invention is to provide an ink cartridge having a wrong prevention mechanism for avoiding forgetting to remove a sealing film on the cover body before the ink cartridge is mounted into the ink jet printer.

In accordance with one aspect of the present invention, an ink cartridge comprising an ink tank body having a plurality of surfaces defining an accommodating chamber therein and an ink outlet part disposed on one of the surfaces thereof. An ink porous member is positioned in the accommodating chamber of the tank body. A cover body has an ink charging inlet and an air inlet part, and being sealed the accommodating chamber of ink tank body. A ventilated screw with a hollow ring is arranged on the air inlet part of the cover body and defines a ventilated channel therein. A tab mechanism is installed to a position on one side of the cover body.

It is to be understood that both the foregoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
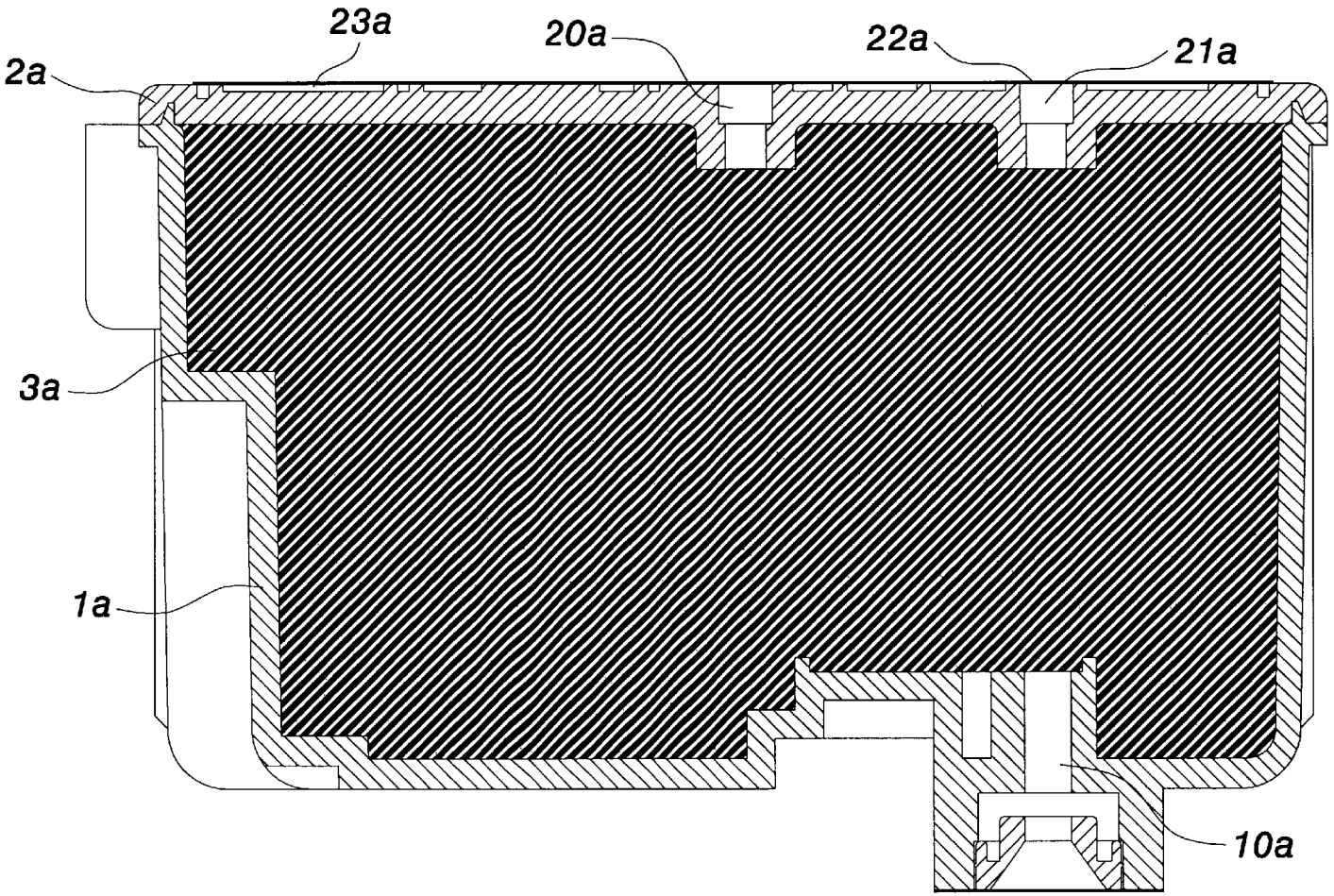
FIG. 1 PRIOR ART
FIG. 1 is a cross-sectional view of prior art.
Figure 2:
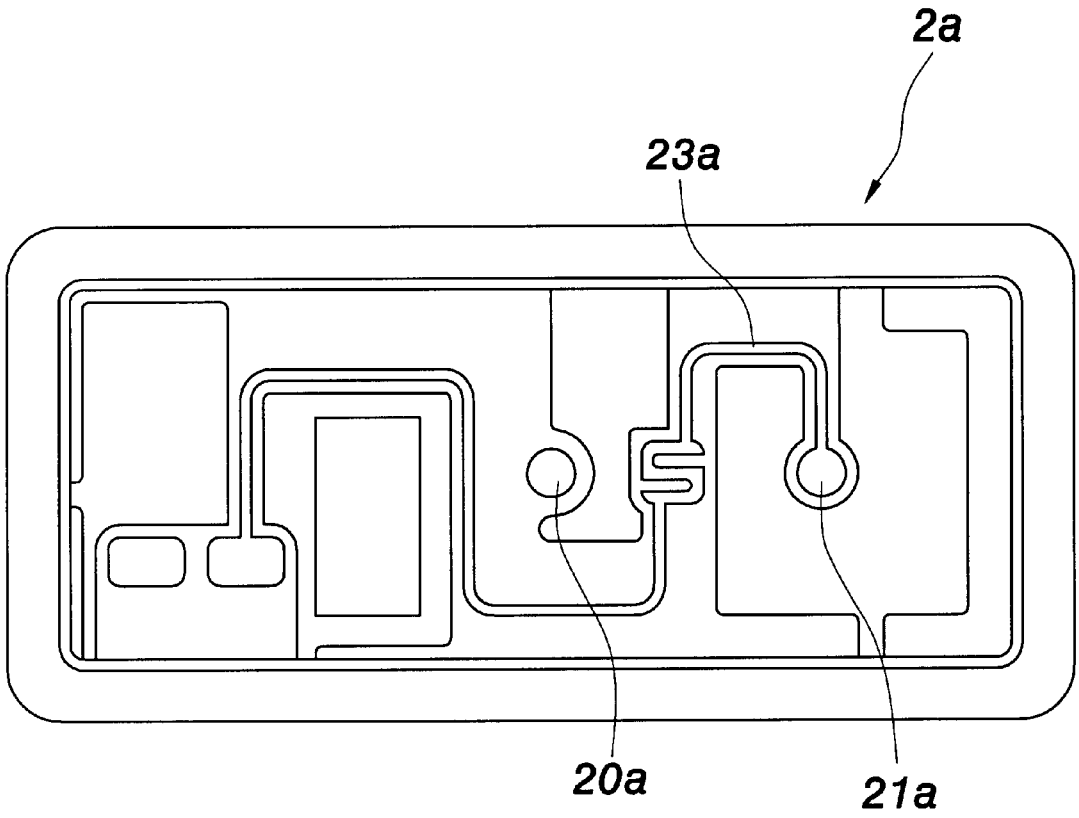
FIG. 2 PRIOR ART
FIG. 2 is a top view of prior art.
Figure 3:
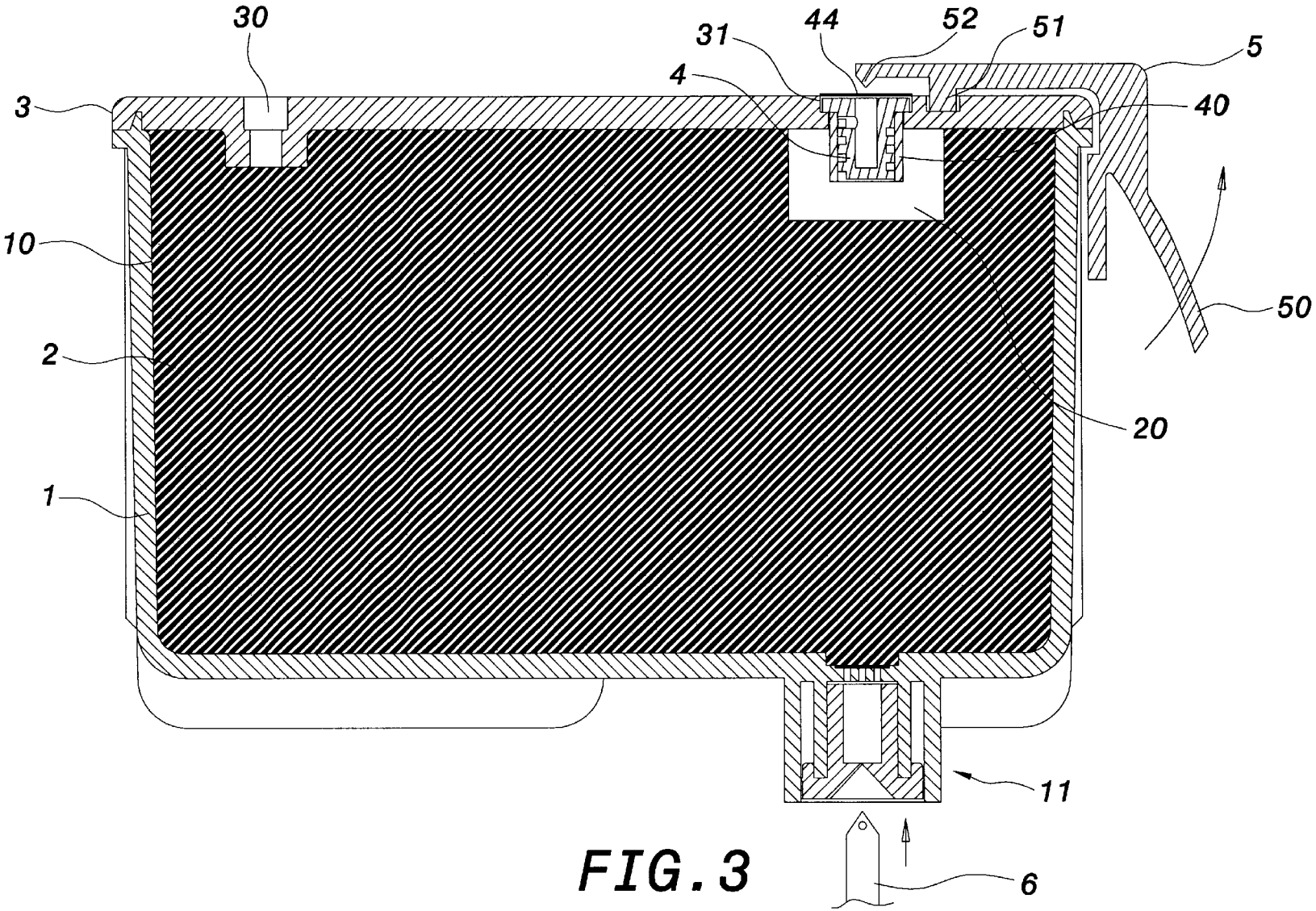
FIG. 3 is a cross-sectional view of the ink cartridge due to the present invention.
Figure 4:
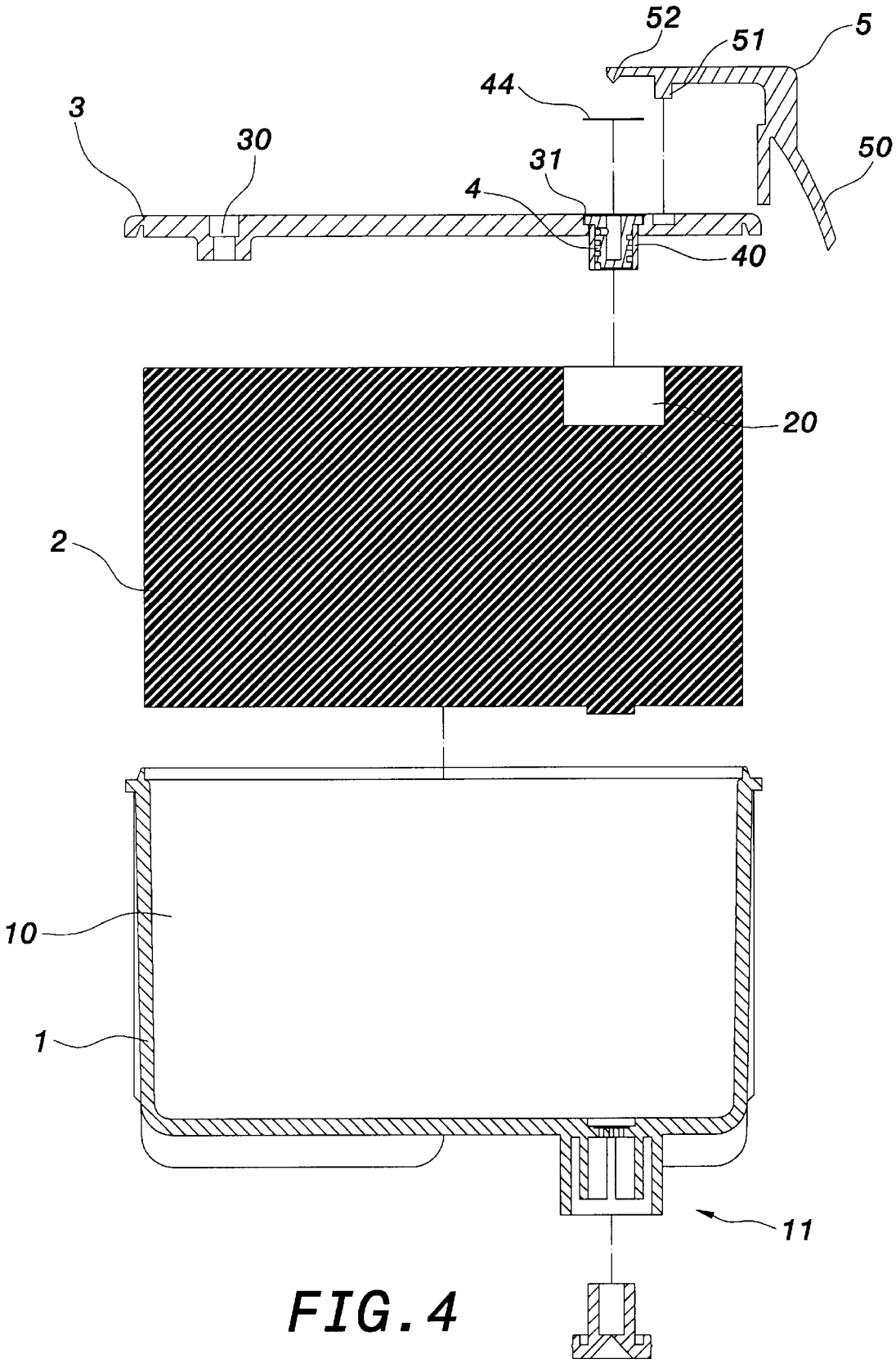
FIG. 4 is an exploded view of the ink cartridge due to the present invention.

Referring to FIGS. 3 to 7, an ink cartridge in accordance with the resent invention comprises an ink tank body 1 for receiving an ink porous member 2 which is a foam material for absorbing ink, a cover body 3 for covering with the ink tank body 1, a ventilated screw 4 with a hollow ring 40, and a tab mechanism 5 can be as a wrong prevention mechanism, wherein:

The ink tank body 1 has a plurality of surfaces defining an accommodating chamber 10 due to single color ink or several accommodating spaces due to multi-color ink. The accommodating chamber 10 can be received with the ink porous member 2, and the ink porous member 2 has a same shape and dimension as the accommodating chamber 10 of the tank body 1. The ink porous member 2 has a plurality of fine holes being impregnated with ink under reduced pressure to substantially eliminate air bubbles therein and an indentation 20 formed on a top surface thereof. The ink tank body 1 has a bottom surface disposed with an ink outlet part 11 which can provide the ink flowed to an ink delivery needle 6 of an ink jet printer.

The cover body 3 has an ink charging inlet 30 and an air inlet part 31 can be passed through in fluid communication with ambient air from the accommodating chamber 10 of the tank body 1, respectively. The cover body 3 has a top surface being smooth, i.e. no circuitous channel is formed thereon.

The ventilated screw 4 has a periphery being surrounded with the hollow ring 40 or integrally formed with the hollow ring 40. The ventilated screw 4 with the hollow ring 40 is arranged on the air inlet part 31 of the cover body 3 as a ventilated system, and defines a longitudinal channel 41, a spiral channel 42 and a lateral channel 43 communicated with the longitudinal channel 41 and the spiral channel 43 (refer to FIGS. 6 and 7), which is form a long distance channel due to the air inlet part 31. According to this arrangement, the atmosphere can be communicated through the longitudinal channel 41, the lateral channel 43, and the spiral channel 42 with an inner surface of the hollow ring 40 to the accommodating chamber 10. It is sufficient to prevent the ink to spread out even if the ink cartridge is turned upside down, thereby also can avoid leaking during transportation, storage, or operation. Another, the ventilated screw 4 has a top surface being overlaid with a sealing film 44 which is a laminated film to seal a top hole of the longitudinal channel 41. The ventilated screw 4 can be correspondingly accommodated in the indentation 20 of the ink porous member 2 so as to form a space for separating the ink porous member 2 and the ventilated screw 4, thereby to reduce the possibility of allowing the ink to flow out through the ventilated screw 4.

Figure 5:
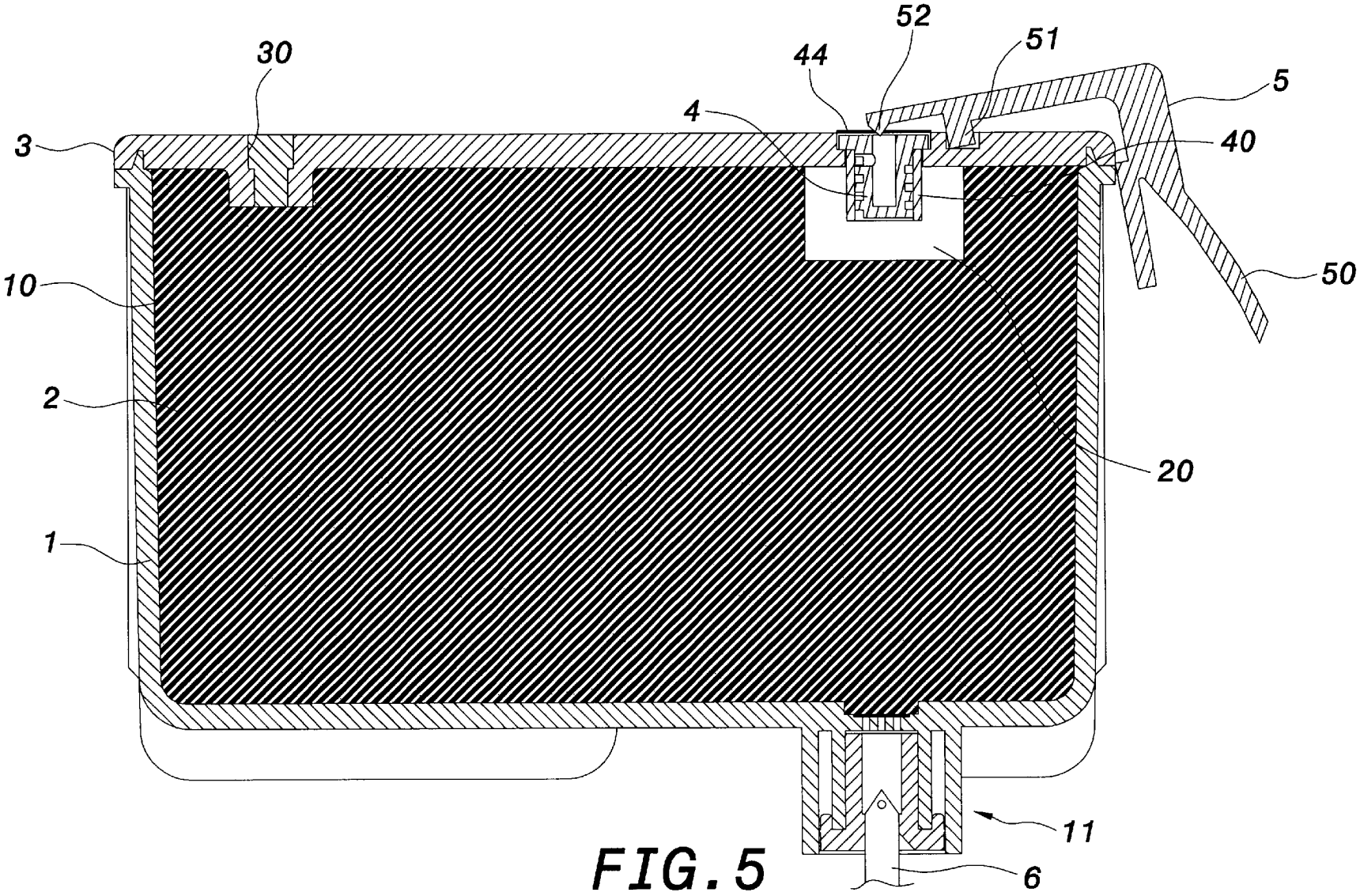
FIG. 5 is a cross-sectional view of the ink cartridge with regard to the tab mechanism is being pivoted.
Figure 6:
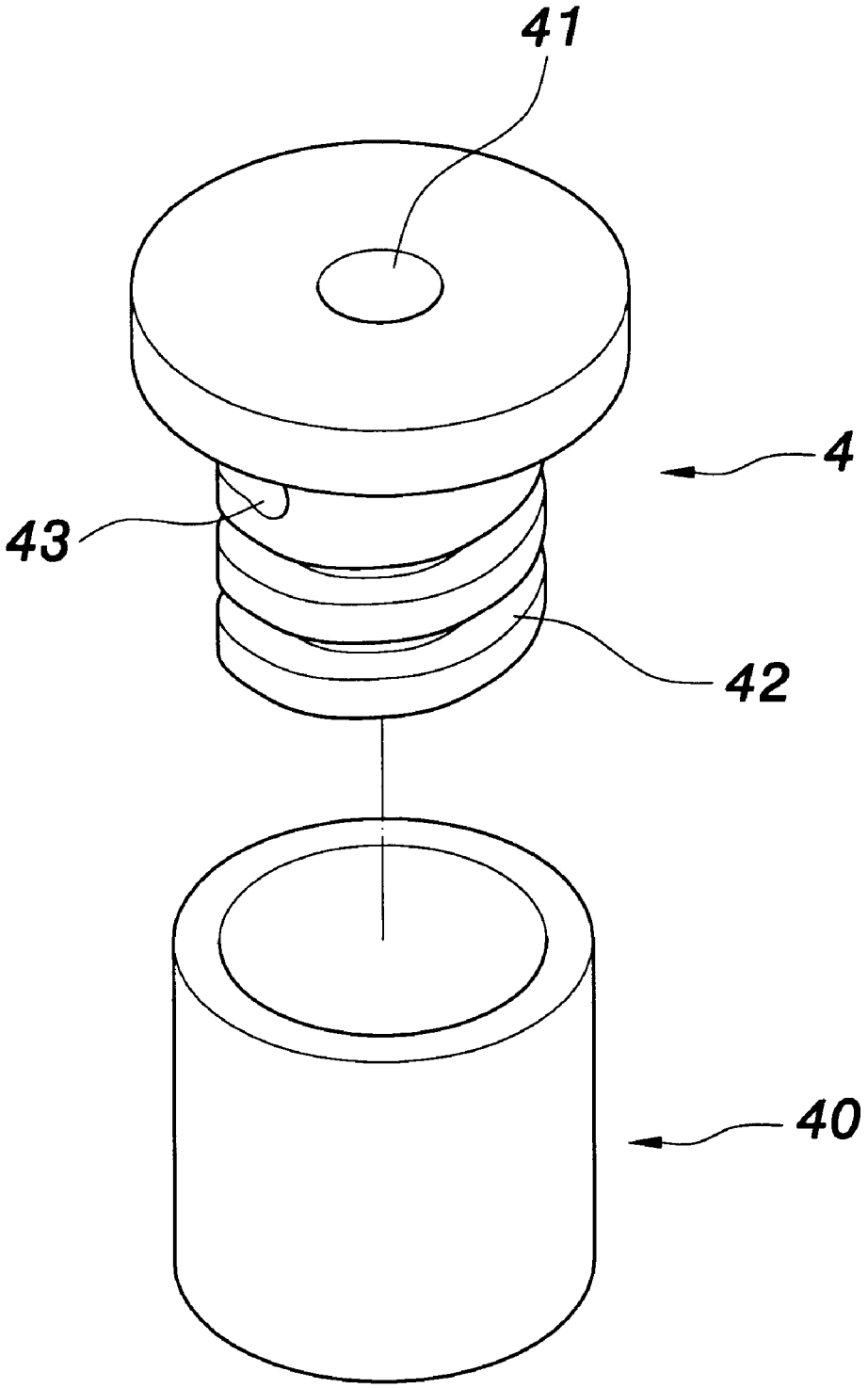
FIG. 6 is a perspective view of the ventilate screw.
Figure 7:
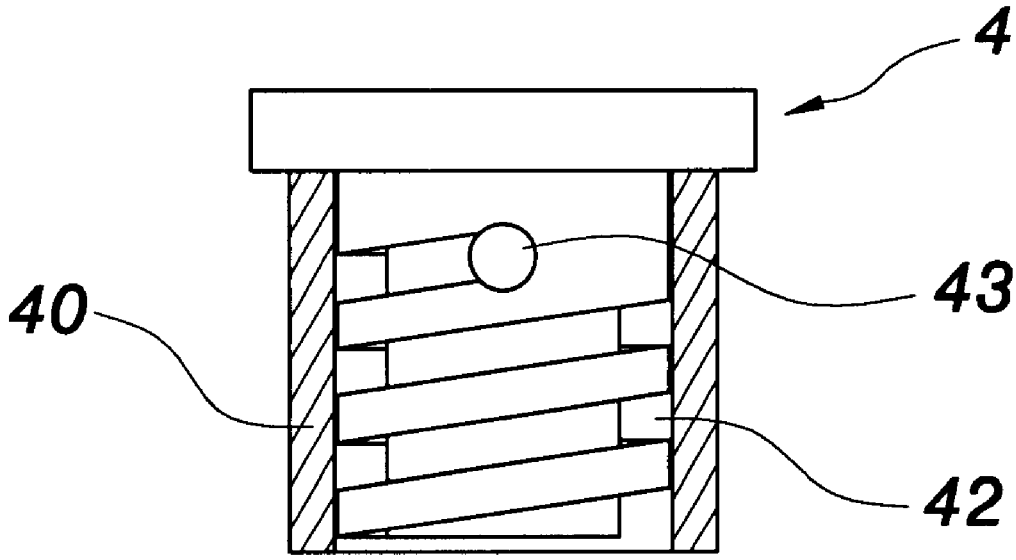
FIG. 7 is a plan view of the ventilate screw.
Figure 8:
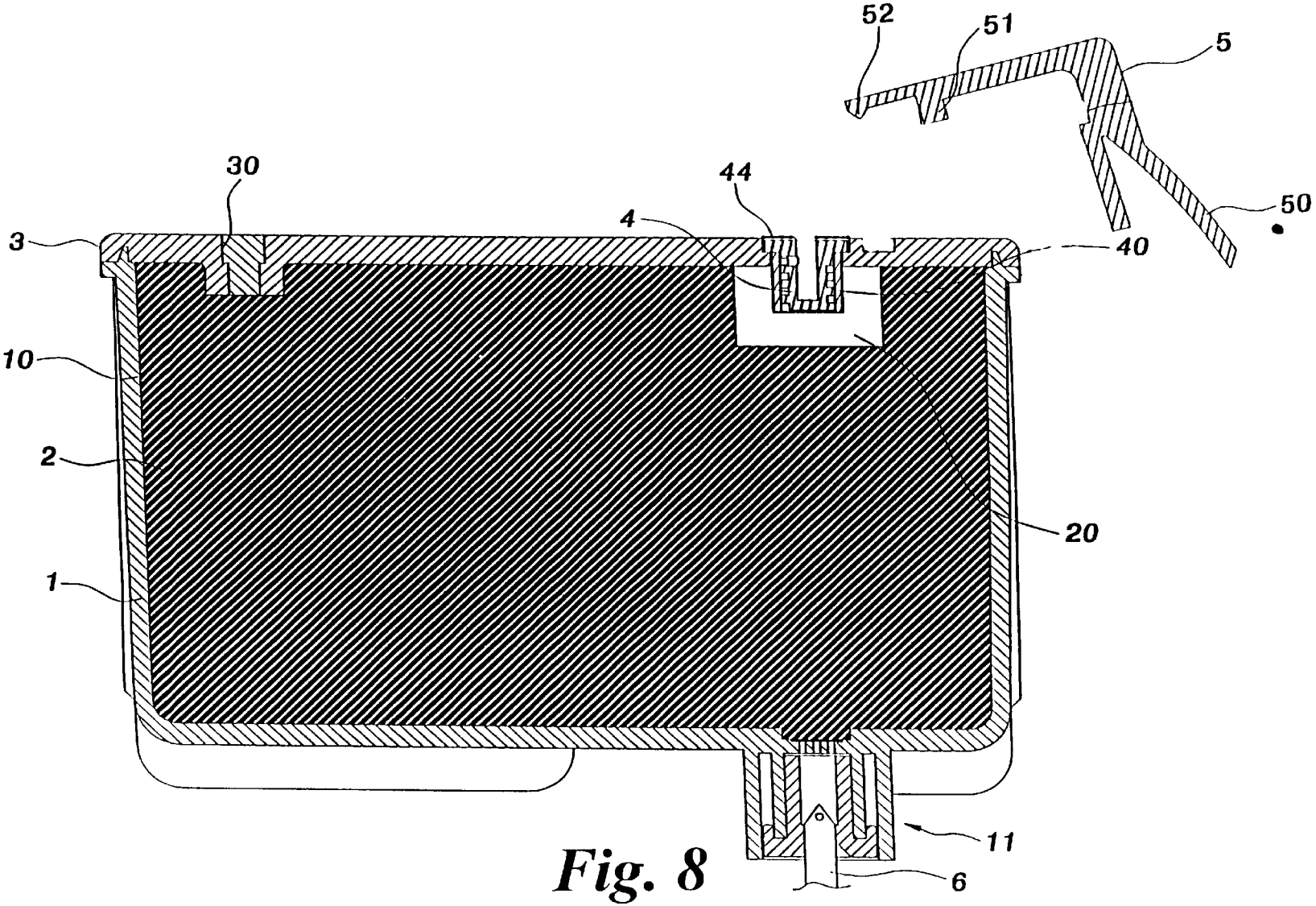

The tab mechanism 5 is installed on one side of the cover body 3. The tab mechanism 5 has a handle 50, a fulcrum 51 supported against the cover body 3 and a sharp end 52 corresponding to the sealing film 44 above the top hole of the ventilated screw 4, the sharp end 52 being positioned to pierce the sealing film 44. That is, the fulcrum 51 is broken off to force the sharp end 52 to pierce the seal film 44 and allow air into the ink cartridge therethrough. FIG. 5 illustrates rotation of lever 5 about fulcrum 51. FIG. 8 shows lever 5 removed from cover body 3 with film 44 now pierced in order to allow air to flow into longitudinal channel 41 of ventilation screw 4. And the distance between the sharp end 52 and the fulcrum 51 is much shorter than the distance between the fulcrum 51 and the handle 50 to provide mechanical advantage.

As installing, firstly to remove the tab mechanism 5, at the same time the sharp end 52 of the tab mechanism 5 to pierce the sealing film 44, then to mount the ink cartridge into the ink jet printer, and the ink in fluid communication through the ink outlet part 11 of the ink tank body 1 to the ink delivery needle 6 of the ink jet printer.

One of the advantages of the present invention is that the ink cartridge can efficiently supply the ink to the ink delivery needle 6 of the ink jet printer without supplying air or air bubbles to the ink delivery needle 6. It is also desirable that the ink cartridge supplies an amount of the ink as required by the ink delivery needle 6 and avoids leaking during transportation, storage, or operation. Additionally, the spiral channel 42 of the ventilated screw 4 is used instead of the circuitous channel on the cover body of the prior art, thereby the cover body 3, of the present invention, has a smooth surface and no grooves or circuitous channels formed thereon. Furthermore, should removal of the tab mechanism 5 be forgotten, the ink cartridge will not be able to be mounted into the ink jet printer successfully, thus providing an error prevention function.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. An ink cartridge comprising:

a hollow ink tank body defining an accommodating chamber therein, an ink outlet port being formed on a lower surface thereof;

a porous member being positioned in said accommodating chamber of said hollow ink tank body, said porous member being saturated with ink;

a cover member having an ink charging inlet and an air inlet port formed therein, said cover member being fixedly secured to said hollow ink tank body and sealing said accommodating chamber of said hollow ink tank body;

a ventilated screw having a ventilation passage formed therein, said ventilated screw having a threaded body member received within a cylindrical housing, said ventilated screw being mounted within said air inlet port of said cover member and defining a ventilated channel therein; and, a tab member being removably secured to said cover member, said tab member being pivotally mounted whereby selective rotation of said tab member about a pivot breaks an air-impermeable film covering said ventilation passage and removes said tab member from said cover member, said ink cartridge being inoperative until said tab member is selectively removed.

2. The ink cartridge as claimed in claim 1, wherein said ink porous member substantially has a same dimension as said accommodating chamber of said hollow ink tank body.

3. The ink cartridge as claimed in claim 1, wherein said ventilated screw further defmes a spiral channel and a lateral channel both in communication with said ventilation passage.

4. The ink cartridge as claimed in claim 1, wherein said ventilated screw is integrally formed with said cylindrical housing.

* * * * *